United States Patent [19]

Adelhard et al.

[11] 4,389,838

[45] Jun. 28, 1983

[54] SINGLE-TWIST STRANDING

[75] Inventors: Georg Adelhard, Nuremberg; Herbert Hasselberg, Lauf; Manfred Obermeier, Eckental; Karl Sierwald, Vaterstetten, all of Fed. Rep. of Germany; József Szedlacsek; Gyorgy Somogyi, both of Miskolc, Hungary

[73] Assignees: Kabelmetal Electro GmbH, Hanover, Fed. Rep. of Germany; Diósgyori Gépgyár, Miskolc, Hungary

[21] Appl. No.: 375,724

[22] Filed: May 7, 1982

[30] Foreign Application Priority Data

Mar. 26, 1981 [DE] Fed. Rep. of Germany ..... 3111872

[51] Int. Cl.[3] ..... D07B 3/08; D07B 7/10; D65H 54/02

[52] U.S. Cl. ..... 57/71; 57/93; 57/98; 57/102

[58] Field of Search ..... 57/67, 68, 70, 71, 92, 57/93, 94, 95, 102, 103, 96, 98, 99

[56] References Cited

U.S. PATENT DOCUMENTS

| | | | |
|---|---|---|---|
| 3,753,342 | 8/1973 | Yoshitake et al. | 57/71 |
| 3,926,072 | 12/1975 | Richardson | 57/102 X |
| 4,085,574 | 4/1978 | McLain et al. | 57/71 X |
| 4,107,912 | 8/1978 | Pockman et al. | 57/68 |
| 4,164,331 | 8/1979 | Henrich | 57/71 X |
| 4,235,070 | 11/1980 | Bravin | 57/99 X |

*Primary Examiner*—John Petrakes

*Attorney, Agent, or Firm*—Ralf H. Siegemund

[57] ABSTRACT

A single-twist stranding machine includes a stranding disc and nipple for stranding together a plurality of filaments, wires, conductors or the like, a rotatably mounted take-up spool onto which the stranded-together elements are wound, a flyer coaxial with the spool and including a frame and deflection pulleys to run the stranded-together elements from the stranding means to the spool, the flyer revolving about the spool, and a common drive motor. The specific improvement disclosed includes a differential gear transmission having two input gears and an output gear; a first transmission for drivingly connecting the drive motor to the flyer, one of the input gears of the differential gear transmission is a part of the first transmission; a second transmission drivingly connects the output gear to the spool for causing the spool to rotate; and a control drive operates the other input gear to vary the speed relation of flyer and spool in dependance upon the input speed of the stranding elements.

11 Claims, 2 Drawing Figures

26
29
22
27
28
25
14
37
36
35
41
39
16
42
40

SINGLE-TWIST STRANDING

BACKGROUND OF THE INVENTION

The present invention relates to a single-twist bunching or stranding machine of the type which includes feed spools for the stock to be stranded, stranding means such as a stationary stranding disc, and a stranding nipple, head, or die, a flyer carrying deflecting pulleys, and a receiving spool or reel being axially displaceable but otherwise mounted inside of the flyer: the flyer is driven by a motor which also drives the receiving spool.

Stranding machines or bunching machines of the type referred to above can be used to make stranded wires, serving as individual conductors. In addition, such a machine can be used for stranding together several conductors or even groups of conductors such as pairs or quads, the latter having been stranded upstream in analogous fashion so that, in effect, a serial or cascading operation of stranding is provided by a plurality of this type of machine. Stranding machines have also been used to provide shields onto insulated conductors or conductor cores. It should be understood, therefore, that stranding elements within the context of this invention, include individual metallic wires or filaments, twisted or stranded wires or conductors, or groups of stranded conductors, etc. In order to facilitate the description of the invention, the stranding of wire filaments to obtain a metallic, stranded wire is used to describe the invention, but it will be understood that the principles thereby explained are applicable to larger units as referred to above.

Stranding of wires or filaments to obtain metallic, multi-wire conductors is particularly employed when the number of wires or filaments to be stranded together is quite large. Generally speaking, one distinguishes between single-twist bunching or stranding and double-twist bunching or stranding. The single-twist stranding machine has the advantage that the resulting multi-wire conductors have very accurate and very accurately predetermined dimensions, and their overall configuration is a highly uniform one. The known single-twist stranding machines are disadvantaged by a rather low manufacturing speed. Still, one has used a single-twist bunching or stranding machine as mentioned above, particularly in those cases in which uniformity and accuracy are of overriding importance. Such highly accurately made conductors are, for example, used in the electrical systems of aircrafts where the diameter of the wires and the utilization of high-quality insulating materials require small dimensions, particularly because of the weight problem in aircraft manufacturing. It can readily be seen that, in this case, accuracy is of overriding importance. On the other hand, a double-twist stranding or bunching machine operates at about a three-fold speed, but the quality of the stranded product is low. One will use this double-twist machine in those cases in which the lower quality can be tolerated, but wherein speed of manufacturing is of overriding importance.

A particularly known single-twist stranding machine is, for instance, constructed to have a stationary distributor disc and a rotating nipple, head or die, in which about 19 wires coming from individual supply spools are combined and stranded together. A withdrawal sheave or capstan and deflection pulleys run the stranded system to a receiving spool for being wound thereon. In order to provide differently long lays in the multi-wire conductor, the machine includes exchangeable wheels, particularly to obtain a step-wise change in stranding length or length of lay. The conductor as made is run over deflection pulleys arranged on the flyer for purposes of winding the stranded conductor onto the receiving spool. The flyer rotates about the same axis as the receiving spool and, in effect, revolves about the latter. In order to permit winding the completed conductor in layers onto the receiving spool, the latter is positioned and moved over its entire length in axial direction. This known machine also includes a brake in order to stop the receiving spool in those cases in which the wire ruptures for any reason. The brake is usually constructed as an induction brake and its braking force is adjustable accordingly. Moreover, the brake is used to some extent during regular operation in that it applies some braking force to the receiving spool during winding of the stranded conductor so that the speed of rotation of the receiving spool is a little below the speed of rotation of the flyer. These two devices are driven by a common motor. By cooperation of these various devices and in correspondence with the withdrawal speed of the caps of the withdrawing capstan, the completed conductor is wound in layers onto the receiving spool.

The brake mentioned above and acting upon the receiving spool is adjustable corresponding to the manufacture of different conductors with a different number of wires or to accommodate wires having different diameters. However, during operation, a running control of the braking force is not provided for in these known devices, so that there is no compensation for the change in winding diameter of the receiving spool when it begins to fill up. Therefore, it is unavoidable that the conductor experiences during manufacture a variable tension, which, in turn, interferes with uniformity in the stranding assembly of the conductor. Another disadvantage of the known machine is to be seen that in the case a wire tears, the motor is stopped and the flyer is also stopped quickly by means of a mechanical brake, but the receiving spool continues to rotate because the induction brake acts somewhat slower. Consequently, the multi-wire conductor is strongly tensioned and may even tear in its entirely. It can readily be seen that it is quite complicated to return such a machine to normal operation once a wire does tear.

DESCRIPTION OF THE INVENTION

It is an object of the present invention to provide a new and improved stranding and bunching machine for elongated stock, in which uniformity and high quality of the resulting stranded product can be achieved but under conditions which overcome the deficiencies outlined above, without substantial increase in equipment expenditure.

It is a particular object of the present invention to provide a new and improved single-twist bunching and stranding machine in which variations in tension load are reduced to a minimum and in which, in the case of a rupture of one of the stranding elements, the machine can be immediately stopped.

It is another object of the present invention to provide a new and improved single-twist bunching and stranding machine which can be run at a higher speed without loss in quality and uniformity of the product.

It is a feature of the present invention to provide a new and improved single-twist stranding machine which includes stranding means such as a disc and a stranding die head or nipple, for stranding together a plurality of elongated elements unwound from individual spools; the machine is to include further a rotatably mounted take-up spool onto which the stranded-together elements are wound, a flyer disposed coaxially in relation to the take-up spool and including a frame and deflection pulleys to run the stranded-together element from the stranding means to the take-up spool, the flyer revolving about the spool; moreover, the machine includes drive means for providing rotation.

In accordance with the preferred embodiment of the present invention, it is suggested to provide, in addition, the improvement which is comprised of a differential gear having two input gears and one output gear; a first transmission drivingly connects the main drive means to the flyer whereby one of the input gears of the differential gear is connected to this first transmission and a second transmission is provided for drivingly connecting the output gear of the differential gear to the take-up spool to thereby cause the spool to rotate; a control drive is drivingly connected to the other one of the two input gears to provide thereto incremental rotation augmenting the rotation of the first mentioned input gear of the differential gear to thereby vary the rotation of the output gear, particularly in response to the speed of at least one of the elongated elements which are being stranded together.

It can thus be seen that in such a particular stranding machine, the flyer and the take-up spool are directly mechanically interconnected via the differential gear and constitute, therefore, with regard to driving as well as to braking, a uniform mass. The flyer, as well as the take-up spool, is, in effect, operated in a mutually controllable relation as far as rotational speed is concerned, mainly owing to the interpositioning of the differential gear. The increase in winding diameter of the stranded product as wound onto the take-up spool requires a certain variation in the rotation of the take-up spool, and this variation is produced by the particular control drive operating the above defined second input of the differential gear. By keeping the withdrawal speed of one or several individual elongated stranding elements constant, in terms of a controlled variable, implicitly a constant lay length results while the speed of winding the stranded product is kept constant as far as the linear speed is concerned, and this in turn results in a corresponding change in the rotational speed relation between flyer and spool. The controlled drive is preferably constructed to provide steady, i.e., stepless, controls which include, if desired, stepless variation in lay length.

In view of the fact that the take-up spool is driven in a controlled fashion as far as rotational speed is concerned, one does not need a particular capstan for pulling the stranded product through the machine. Also, a special brake for the take-up spool is not required. In the case one of the filaments or wires, i.e., one of the stranding elements, tears, flyer and take-up spool are immediately stopped together because they are rotationally interconnected whereby the particular operating state as it existed on account of the control conditions just prior to tearing, is maintained without detrimentally affecting the stranded product. In view of the fact that the rotation relation between flyer and take-up spool is subject to control, one obtains a considerable increased safety in the operation, and the production speed can be increased without loss in quality of the product. It was found, moreover, that the number of deflection pulleys for the flyer can be reduced as compared with some prior art machines, and the avoidance of a withdrawing capstan is, in addition, of advantage in order to shorten the axial dimensions of the flyer. This does not only reduce the mass of the flyer, but it was found that the flyer attains greater stability which regard to any tendency to oscillate and vibrate.

The particular interpositioning of the differential gear in the machine, i.e., its location within the overall drive train, is basically not critical. By way of example, the one input gear for the differential gear can be placed on a shaft which is driven by the main drive, and from which additional driving motion is derived, preferably for both sides of the flyer. The output gear in this case will then be drivingly coupled to a shaft on which sits the take-up spool. The withdrawal speed of the individual stranding elements, or the individual wires, is preferably ascertained by a suitable transducer feeding its output to a controller, which in turn operates the augmenting drive, by means of which any supplemental rotation is imparted upon the differential gear. Any change in withdrawal speed is therefore directly effective on the speed relation between take-up spool and flyer. This, then, ensures a continued accuracy in the quality of the stranded product.

The entire control of the stranding machine may be obtained by means of an electronic computer. Different input data are fed to the computer, such as withdrawal speed of the individual filaments, i.e., stranding elements, and the desired lay length of the individual elements within the stranded product is an additional input parameter for such a computer. Moreover, the winding diameter of the stranded product on the spool may be ascertained separately and its variations are acquired as another input parameter for the computer. The computer itself may operate on the basis of comparing desired with actual values, and any deviation results in a particular control input fed to the differential gear for augmenting the drive speed of the take-up spool vis a vis the flyer, and any incorrect relationship between their rotational speeds is immediately corrected by operation of the differential gear.

The winding operation of the stranded product onto the spool requires alternating back and forth axial movement of the spool in relation to the flyer. For this reason, it is suggested to include a particular drive shaft which is received by a hollow shaft which, in turn, carries the spool. Preferably, a spline connection is used for drivingly connecting the drive shaft or carrier shaft in positive fashion to the hollow shaft. Back and forth motion is imparted upon the take-up spool by moving the hollow shaft accordingly without interruption in the driving connection to the carrier shaft.

The inventive machine includes, additionally, a particular releasable mounting structure for the carrier shaft, providing for further reduction in the propensity of the device to undergo vibrations while a fixed point for torque transmission is established. The machine is further constructed to permit easy replacement of a filled take-up spool by an empty one.

DESCRIPTION OF THE DRAWINGS

While the specification concludes with claims, particularly pointing out and distinctly claiming the subject matter which is regarded as the invention, it is believed that the invention, the objects and features of the invention, and further objects, features and advantages thereof, will be better understood from the following description taken in connection with the accompanying drawings, in which:

Figure 1:
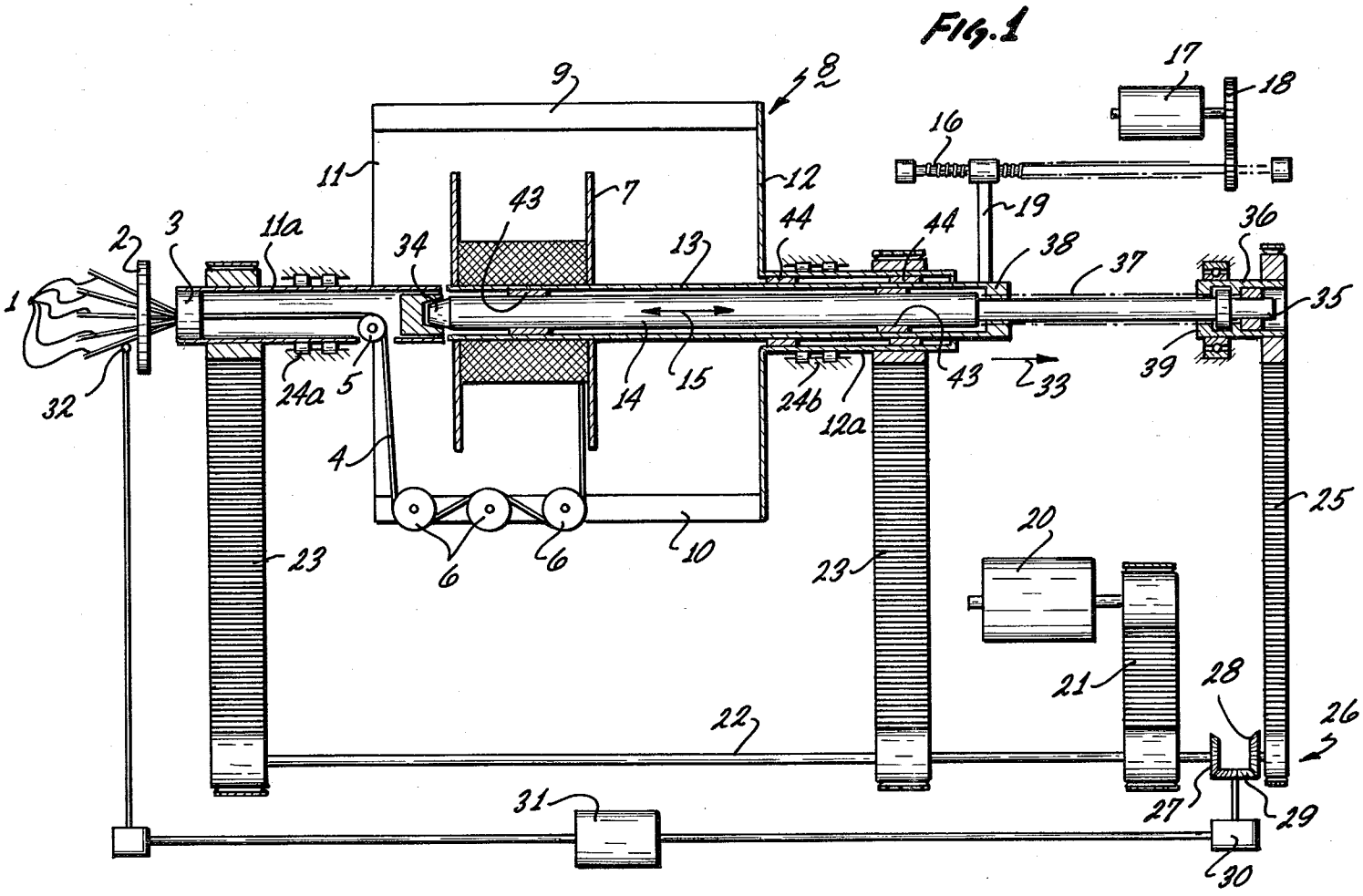
FIG. 1 illustrates a single-twist stranding and bunching machine. The illustration is somewhat schematic and includes only parts essential for explaining the invention; otherwise, the figure illustrates an example of the preferred embodiment of the invention for practicing the best mode thereof.

Proceeding now to the detailed description of the drawings, the figures show a plurality of individual metal wires 1 which are drawn from individual supply reels or spools (not shown) and are combined by means of a stranding and distributing disc 2 which runs these individual wires towards a stranding nipple or die 3. This particular stranding nipple or die may be provided for rotation within the machine. In any event, the nipple constitutes the stranding point in which the individual wires are stranded together to a multi-wire conductor or a multi-filament wire 4. The completed stranded wire 4 emerges from the stranding nipple 3 and runs towards a deflection sheet or pulley 5 and from there, via several deflection pulleys 6 to a receiving reel or spool 7 onto which the completed multi-strand wire 4 is wound.

The three deflecting reels or pulleys 6 are arranged on a flyer 8 which includes two bars 9 and 10 held together by suitable frame elements 11 and 12 so as to be disposed in 180-degree opposing relation to each other and with respect to the stranding axis. The frame elements 11 and 12 each have respectively tubular extensions 11*a* and 12*a* by means of which the frame and flyer, as a whole, is journaled in a stationary stand, journaling being accomplished by means of bearings 24*a* and 24*b*, so that the flyer is rotatable about that common axis.

A receiving spool 7 is secured to a hollow shaft 3 which, in turn, receives a particular carrier shaft 14. Splines 37–38 connect shaft 14 and shaft 13. The shafts 13 and 14 are both axially (but independently) displaceable as indicated by the double arrow 15. The axial displacement of the hollow shaft 13 is effected by a structure 16 which, for example, is provided as a threaded spindle or geared bar which in turn in driven by a motor 17 via a gear transmission 18. The threaded spindle 16 is driving a connecting rod 19 which, in turn, has its other end connected to the hollow shaft 13.

It can thus be seen that, upon alternating rotation of the threaded spindle 16, the arm or bar 19 is moved back and forth, and that back and forth movement is imparted upon the hollow shaft 13 as represented by the double arrow 15. This back and forth movement is limited by the frame elements 11 and 12 of the flyer 8 because the axial movement of the spool 7 on shaft 13 occurs in effect within the construction of the frame elements 11 and 12 and they constitute limits for such movement accordingly. The shaft 14 is likewise moveable in the direction of the double arrow 15, but that movement is independent of the movement of hollow shaft 13, the displacement of shaft 14 being provided primarily for purposes of permitting an exchange of the spool 7, i.e., an exchange of a filled spool for an empty one. Shaft 14 retains its axial disposition during normal operation.

The stranding machine, in addition, includes a driving motor 20 which is preferably constructed as a DC motor. The motor 20 drives a transmission shaft 22 via a toothed belt 21. The shaft 22 in turn serves as an input for a belt transmission having two branches, 23 and 23*a*, which, in a more or less balanced configuration, drive the two frame journals, 11*a* and 12*a* to thereby drive the flyer 8 from both of its sides (axially). This symmetry avoids one-sided loading. Brakes 24 are provided to both sides of the flyer 8 and they are preferably constructed as disc brakes.

The shaft 14 is driven also by the motor 20 and for this, a differential transmission gear 26 is provided, cooperating with another belt transmission 25, coupling the output gear 28 or gear 26 to the shaft 14. It should be mentioned that the various transmissions 21,23 and 25 are, in the preferred form, constructed as belt transmissions with toothed endless belts, but other forms of transmissions can be provided as well.

The differential gear transmission 26 is, in the preferred form, constructed so that the transmission shaft 22 acts on a drive and first input gear 27 of the differential gear transmission. The output or exit gear 28 is connected to the shaft 14 by the belt transmission 25 as described so that, in this way, the shaft 14, and the hollow shaft 13 being coupled to shaft 14, are driven by and from the motor 20. The same holds true for the receiving spool 7 because that spool is, as stated above, secured to the hollow shaft 13 and rotates therewith.

The differential gear 26 includes a second or control input provided by a drive 30 and operating the control gear 29 of the differential gear transmission 26. Drive 30 can be controlled to rotate in opposite directions and for this the drive 30 is controlled by a controller or control circuit 31. As stated above, circuit 31 may be a computer. The controller 31 receives, for example, as an input, the output of a transducer 32 which monitors the withdrawal speed of one or more of the individual wires. This speed is the running, steady-state input for determining the speed of the drive 30. Another input for the controller 31 is preferably the current diameter of the spool 7, this being a parameter which, step-wise, increases during operation and gradual filling of the take-up spool.

As far as the control operation is concerned, the following should be observed. Assuming for a moment that the output speed of drive 30 has a particular value that remains constant, then the shaft 14 is driven at a constant speed, having a fixed differential in relation to the speed of flyer 8. This, then, results in a particular winding speed and in a particular linear speed of the stranded wire or conductor 4, and that, in turn, results in a particular speed of the individual wires or filaments 1. A steady state can readily be obtained in this fashion. Now assume that the spool 7 fills, the diameter of winding increases, and that in turn increases the linear speed of product 4 which, in turn, increases the speed of the individual filaments 1. The internal control operation of circuit 31, being designed to maintain a constant speed of filaments 1, will accordingly reduce the incremental rotational input provided by and in the differential gear 26, by operation of the elements 29 and 30. The rotational speed of the spool 7 will then, therefore, be reduced. It is, however, of advantage to augment that particular control action by sensing the winding diameter on spool 7, which means that, in effect, a speed change in the differential gear transmission 26 and in the elements 30 and 31 ensues before an undue increase in speed of the filaments 1 is observed. Thus, the first mentioned control operation will, in this case, act only as a residual and fine control in order to enhance accuracy of the operation, while the spool speed is reduced in open loop control in response to spool diameter sensing.

It should be mentioned further that the differential gear 26 could be constructed and arranged so that the output gear 28 sits directly on the shaft 14. This aspect depends on the overall construction as well as on the available mounting space.

FIG. 1 illustrates a particular operational state of the stranding machine in which the stranded conductor 4 is already being wound onto the spool 7. In order to place the spool 7 into the machine it is necessary at first, that is, prior to any stranding operation, to move the shaft 14 as well as the hollow shaft 13 in the direction of arrow 33 until there is enough space available for laterally placing the spool 7 into the flyer 8 and its frame 11, 12. Holding that spool in proper axial position is required to subsequently insert the shaft 14 and 13 into the spool whereupon the spool 7 is secured to the hollow shaft 13, e.g., when in the position as illustrated. The stranded conductor 4 is taken up by the spool 7 at the right-hand margin.

In order to provide a highly stable arrangement, particularly with regard to the two shafts 13 and 14, the free end of shaft 14 should be supported in a bearing 34 inside journal tube 11*a* holding the rotatable bearing element 34. Bearing 34 is constructed to receive the front end of shaft 14 for connection thereto to obtain common rotation. By means of an appropriate nut or the like, the shaft 14 may be connected to the bearing element 34. This, or any alternative fastening means not illustrated, is of conventional design; it is essential that securing the shaft 14 to the bearing element 34 axially positions the shaft 14.

The other end of the shaft is provided with a rubber elastic element, e.g., a rubber ring, 35, which will radially expand when the shaft 14 is moved to the right and will, in fact, be urged against a tube 36. This particular tube 36 is drivingly connected directly to the transmission belt 25 and rotational power is transmitted from the belt via the tube 36 and a spline connection 39/37 to the shaft 14.

The particular resilient support of shaft 14 on one side has the added advantage of a considerable reduction in the propensity of the machine to undergo internal vibrations. One has, in fact, obtained here a fixed point for the torque transmission at the point of spline engagement 39–37; that fixed point of torque transmission is not only not interfered with by the resilient characteristics of element 35, but the latter insures the retention of the transmission point particularly in the case vibrations tend to develop but are indeed suppressed.

As stated earlier, the hollow shaft 13 is positively connected to the shaft 14 for purposes of torque transmission by means of the same spline arrangement 37 on shaft 14 engaging also a matching spline 38 of hollow shaft 13. Axially short, slideable bearings 43 and 44 support, in addition, shaft 14 inside hollow shaft 13.

In operation, upon turning on of the stranding machine, flyer 8 as well as receiving and take-up spool 7 begin to rotate. The speed of rotation of the spool 7 may be a little higher or a little lower than the speed of rotation of the flyer 8 and that speed differential is responsible for winding the stranded conductor 4 onto the spool in one direction or the other. It should be noted that the spool 7 operates as a withdrawing capstan in the general sense, for pulling the conductor 4 and the wires through the stranding machine. This way, one does not need a particular withdrawal capstan or sheave for that purpose. The transmission shaft 22 provides rotational torque and power via the transmission belts 23, 23*a* to the flyer 8. Torque is imparted upon the spool 7 via the transmission belt 25, the shaft 14, and the hollow shaft 13 as splined to the shaft 14.

Concurrently thereto, but independently from the foregoing, motor 17 is turned on so that the winding control device begins to operate. The rotation of the spindle 16 of that device causes the rod 19 to move in the direction of arrow 33, carrying along the shaft 13 so that, upon rotation of the spool 7, one loop of stranded conductor is wound next to the respectively previously wound one in progressing helical fashion. The shaft 14 remains in the axially predetermined and tensioned position and the particular resilient support takes up readily any oscillations that may occur and be set up. During operation, therefore, device 16 moves the spool 7 slowly back and forth so that the stranded wire or conductor 4 is wound loop next to loop and in sequential layers upon the spool.

The withdrawal speed of the individual wires 1 is ascertained by the transducer 32 and acquired as an input by the controller 31. The controller 31 operates the drive 30 in such a manner that with increasing winding diameter of the spool 7, due to the winding of conductor material thereupon, one obtains continuously proper matching of the speed of rotation of spool 7, i.e., a gradual reduction in its rotational speed so that the linear speed of the stranded conductor 4 remains constant. The operation in this regard is, of course, the result of the driving connection between the drive 30 and the spool 7 by means of the differential gear 26 which establishes this incremental change in rotational speed of the hollow shaft 13.

As stated above, in this particular peferred form of the preferred embodiment, the differential gear 26 has its primary input gear 27 arranged directly on the transmission shaft 22. However, it is readily possible to provide the differential gear elsewhere within the drive train of the system. Generally speaking, one of the three gears 27, 28 and 29 must be connected in driving fashion to the spool 7, a second one to the flyer 8 and the third one receives the control input from the drive 30. The matching and actual gearing connection can be modified as long as this three-way connection is ensured.

Figure 2:
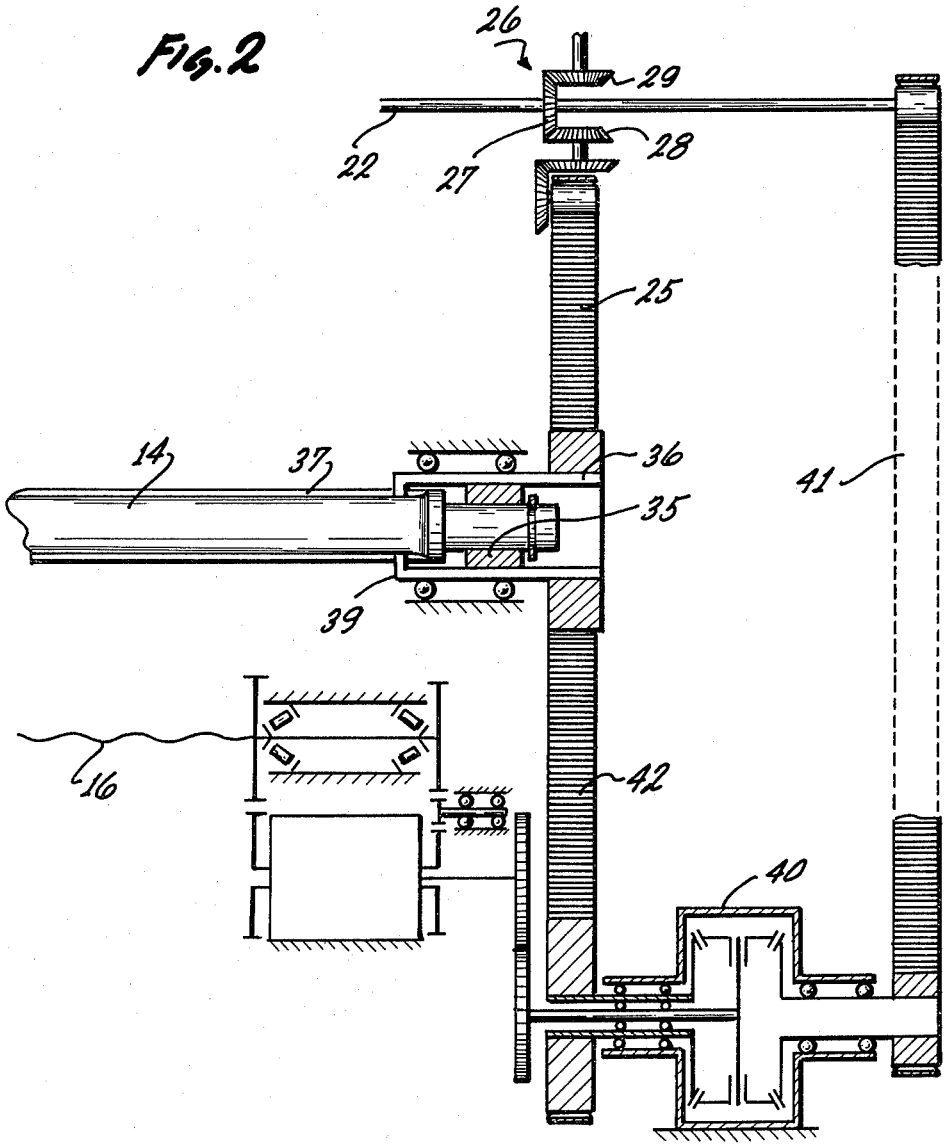
FIG. 2 illustrates a portion of the machine shown in FIG. 1 but including a modification.

In order to improve accuracy of the operation of spindle 16, interpositioning of another differential gear, such as differential gear 40, is well conceivable as shown in FIG. 2. The differential gear 40 receives an input representing the rotation of the flyer 8. This is schematically indicated by an extrusion of which shaft 22 drives, directly, the flyer 8 as shown in FIG. 1. That extension drives a transmission belt 41, serving as a first input for gear 40. The second input for that differential gear 40 is derived from shaft 14 via a transmission belt 42. That input represents directly the speed of rotation of spool 7. The output of differential transmission 40 operates spindle 16 via a variable direction transmission 43. Thus, the spool and winding control 16 operates, in this case, directly proportional to the difference between the speed of winding the conductor 4 and the rotational speed of the flyer 8. The transmissions 41 and 42 are also constructed here as two belts, but other types of transmissions are conceivable.

In FIG. 1, the flyer 8 is axially dimensionsed to have about twice the axial length as compared with the length of the spool 7. This is, so to speak, a minimum axial length for the flyer and is simply required because the spool 7 should be axially displaceable for about at least its own axial length, otherwise one couldn't wind the conductor onto the spool 7 in its entirety. It is, however, desirable not to construct the flyer 8 any longer, so that the bars 9 and 10 are not too long, which is of advantage from the point of view of a robust construction and minimizing vibrations and oscillations. This particular feature results in a rather high degree of efficiency, but it can be improved further by streamlining the bars 9 and 10 to assume minimum air resistance characteristics, and it was found that by this simple feature, the power consumption of the flyer can be reduced by about 25%.

The invention is not limited to the embodiments described above; but all changes and modifications thereof, not constituting departures from the spirit and scope of the invention, are intended to be included.

We claim:

1. A single-twist stranding machine including stranding means for stranding, bunching and twisting together a plurality of elongated elements such as filaments, wires, conductors or the like, a rotatably mounted take-up spool onto which the stranded-together elements are wound, a flyer coaxial with the spool and including a frame and deflection pulleys to run the stranded-together elements from the stranding means to the spool, the flyer revolving about the spool, and drive means for providing rotation, the improvement comprising:

a differential gear transmission having two input gears and an output gear;

first transmission means for drivingly connecting the drive means to the flyer, one of the input gears of the differential gear transmission being connected to the first transmission means;

second transmission means for drivingly connecting the output gear to the spool for causing the spool to rotate;

a control drive drivingly connected to another one of the input gears to provide thereto incremental rotation augmenting the rotation of the first input gear to, thereby, vary the rotational output gear; and means responsive to the speed of at least one of the elongated elements for controlling the control drive.

2. The improvement as in claim 1, the second transmission means including a hollow shaft carrying the spool, the carrier shaft traversing the hollow shaft and being releasably and axially displaceable connected thereto, there being further transmission means for coupling the carrier shaft to the output gear.

3. The improvement as in claim 2, the hollow shaft being axially displaceable in the flyer to thereby displace the spool relative to the pulley means for obtaining progressive loops on the spool.

4. The improvement as in claim 3 and including additional drive means connected for moving the hollow shaft back and forth.

5. The improvement as in claim 4, the additional drive means including another gear for tapping rotational power from the drive means.

6. The improvement as in claim 2, the carrier shaft being journaled on both ends but being axially moveable and disengageable from a journal on one of the ends.

7. The improvement as in claim 6, the other end being additionally mounted by means of an elastically compressable element.

8. The improvement as in claim 2, there being splined means for drivingly connecting the carrier shaft to the hollow shaft.

9. The improvement as in claim 1, the first transmission means including a transmission shaft, drivingly connected to the drive means, and belt means for connecting the shaft to the flyer, that one input gear sitting on the shaft.

10. The improvement as in claim 9, the belt means including a first and a second belt for coupling the shaft to opposite ends of the flyer.

11. The improvement as in claim 1, said flyer including streamlined elements.

* * * * *